US008776459B1

(12) United States Patent
Theophilus

(10) Patent No.: US 8,776,459 B1
(45) Date of Patent: Jul. 15, 2014

(54) ADAPTABLE BASEMENT WINDOW FRAME SYSTEM

(76) Inventor: Morgan F. Theophilus, Urbandale, IA (US)

( * ) Notice: Subject to any disclaimer, the term of this patent is extended or adjusted under 35 U.S.C. 154(b) by 123 days.

(21) Appl. No.: 12/888,508

(22) Filed: Sep. 23, 2010

(51) Int. Cl.

| | |
|---|---|
| ***E06B 1/56*** | (2006.01) |
| ***E06B 3/667*** | (2006.01) |
| ***E06B 3/54*** | (2006.01) |
| *E06B 1/02* | (2006.01) |

(52) U.S. Cl.
CPC . *E06B 3/667* (2013.01); *E06B 1/02* (2013.01); *E06B 3/5454* (2013.01)
USPC ..... 52/204.72; 52/204.71; 52/204.7; 52/745.21; 52/208

(58) Field of Classification Search
CPC ..... E06B 3/5454; E06B 3/667; E06B 3/003; E06B 1/02; E06B 1/045; E06B 1/56
USPC ..... 52/217, 204.52, 204.72, 216, 213, 210, 52/208, 204.7, 204.71, 271, 745.21, 275, 52/474, 282.3, 204.595, 281; 49/404, 411, 49/413
See application file for complete search history.

(56) References Cited

U.S. PATENT DOCUMENTS

| | | | | | |
|---|---|---|---|---|---|
| 1,458,025 | A | * | 6/1923 | Biele | 52/217 |
| 1,496,525 | A | * | 6/1924 | Coco | 52/217 |
| 1,614,318 | A | * | 1/1927 | Ricken | 52/217 |
| 2,015,447 | A | * | 9/1935 | Esser | 52/204.55 |
| 2,207,745 | A | * | 7/1940 | Lipsett | 52/209 |
| 2,289,558 | A | * | 7/1942 | Thompson | 52/204.52 |
| 2,595,506 | A | * | 5/1952 | Backman | 52/127.12 |
| 2,743,795 | A | * | 5/1956 | Taubman | 52/217 |
| 2,768,410 | A | * | 10/1956 | Woodard | 52/204.56 |
| 2,856,040 | A | * | 10/1958 | Dansereau | 49/408 |
| 3,156,331 | A | * | 11/1964 | Sklar | 52/215 |
| 3,570,203 | A | * | 3/1971 | Williams | 52/217 |
| 3,599,381 | A | * | 8/1971 | Gartner | 52/217 |
| 4,222,458 | A | | 9/1980 | Pratt | |
| 4,246,731 | A | | 1/1981 | Miro | |
| 4,277,920 | A | * | 7/1981 | Dixon | 52/64 |
| 4,370,828 | A | | 2/1983 | Miro | |
| 4,430,831 | A | | 2/1984 | Kemp | |
| 4,453,346 | A | * | 6/1984 | Powell et al. | 49/404 |
| 4,574,547 | A | * | 3/1986 | Menchetti et al. | 52/238.1 |
| 4,589,624 | A | | 5/1986 | Jones | |
| 4,680,902 | A | * | 7/1987 | Stefnik et al. | 52/126.4 |
| 4,698,944 | A | * | 10/1987 | Wilkins, Jr. | 52/211 |
| 4,756,135 | A | | 7/1988 | Citrullo et al. | |
| 4,841,696 | A | * | 6/1989 | Miller | 52/202 |
| 5,279,086 | A | * | 1/1994 | Liao | 52/212 |
| 5,319,884 | A | | 6/1994 | Bergeron | |
| 5,603,191 | A | * | 2/1997 | Wu | 52/204.1 |
| 5,687,540 | A | | 11/1997 | Thomas | |
| 5,881,510 | A | * | 3/1999 | Ole | 52/217 |
| 5,893,431 | A | | 4/1999 | Cranswick et al. | |
| 6,067,754 | A | | 5/2000 | Bellart | |
| 6,098,355 | A | * | 8/2000 | Li | 52/212 |

(Continued)

*Primary Examiner* — Phi A
(74) *Attorney, Agent, or Firm* — Zarley Law Firm, P.L.C.

(57) ABSTRACT

A window frame system having a window frame and cavity frame formed to frictionally fit within the window frame. An opening is cut in a wall based on measurements of the cavity frame, and the ends of the cavity frame are trimmed based upon the opening cut in the wall. Jack screws are inserted through holes in the window frame to center and level the system by pushing the cavity frame away from the window frame to engage the edges of the opening.

6 Claims, 3 Drawing Sheets

(56) References Cited

U.S. PATENT DOCUMENTS 6,173,541 B1 * 1/2001 Petta ..... 52/204.5
6,185,884 B1 2/2001 Myers et al.
6,826,878 B1 * 12/2004 Rovtar ..... 52/213
6,874,286 B2 * 4/2005 Tavivian ..... 52/217
6,904,727 B2 6/2005 Edger
7,490,442 B1 2/2009 Jackson et al.
7,987,637 B2 * 8/2011 Smith ..... 52/126.1
2009/0025320 A1 * 1/2009 Wagner et al. ..... 52/217

* cited by examiner

ADAPTABLE BASEMENT WINDOW FRAME SYSTEM

BACKGROUND OF THE INVENTION

This invention is directed toward a window for installation in a basement and more particularly to a window frame that is adaptable for installation in a basement. Homeowners install basement windows ranging in size from 3'×4' to 5'×6' in their lower living areas to meet the egress requirements for residential building codes. Basement windows require a frame to be sized and squared within an opening by approximately ⅛ of an inch. This is virtually impossible to do when cutting a cavity into an existing concrete or masonry wall. The current practice is to cut the hole and then construct a wood frame that is the proper size and square. The frame is then shimmed to fit the cavity and attached to the cavity walls with concrete fasteners. Then the window is mounted to either to room side or exterior outside of the wooden frame with an integral nailing fin. Insulation foam is used to fill both between the window frame and the cavity and the wood frame and the window is then caulked in place for a weather tight installation. All of these steps are time consuming and require both skill and care for a quality window installation.

Accordingly, there exists a need in the art for a frame that can be installed directly into the cavity that accommodates the normal square and size variations inherent to the concrete cutting process.

An objective of the invention is to provide a window frame that has a rigid frame opening correct in size and square for the window to be installed and be able to be installed directly in the opening cut in concrete or masonry for the window without being shimmed in place.

A further objective of the invention is to have a frame system that does not require constructing a frame system on site for the window cavity cut into the wall.

A further objective of the invention is to provide an adaptable frame system that will accept current basement window designs with integral weather stripping designed for poured in place window frames.

These and other objectives will be apparent to one of ordinary skill in the art based upon the following drawings, written description, and claims.

BRIEF SUMMARY OF THE INVENTION

A window frame system having a window frame and cavity frame formed to frictionally fit within the window frame. An opening is cut in a wall based on measurements of the cavity frame, and the ends of the cavity frame are trimmed based upon the opening cut in the wall. Jack screws are inserted through holes in the window frame to center and level the system by pushing the cavity frame away from the window frame to engage the edges of the opening.

DETAILED DESCRIPTION OF THE PREFERRED EMBODIMENT

Figure 2:
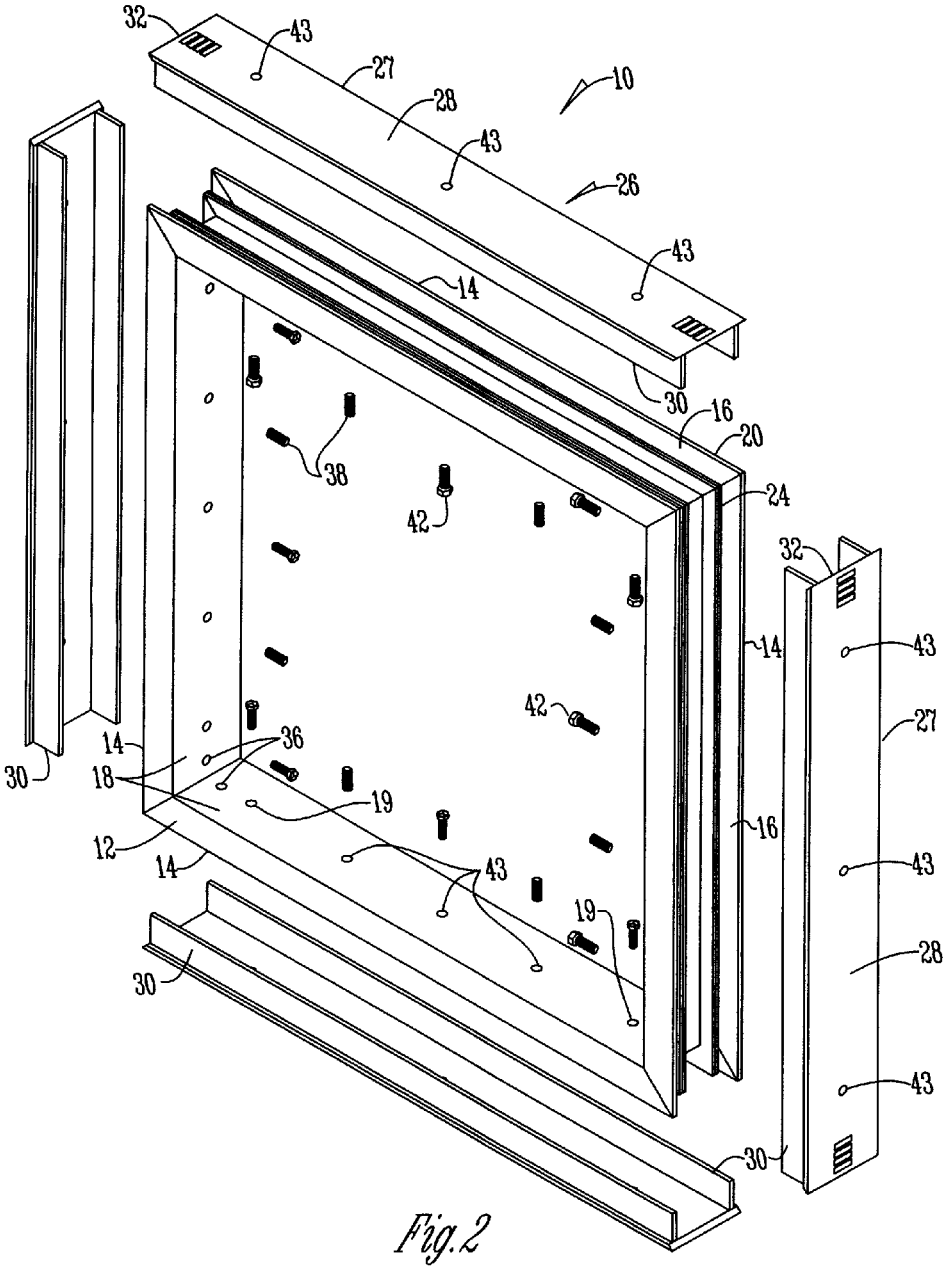
FIG. 2 is a perspective exploded view of a frame system.
Figure 3:
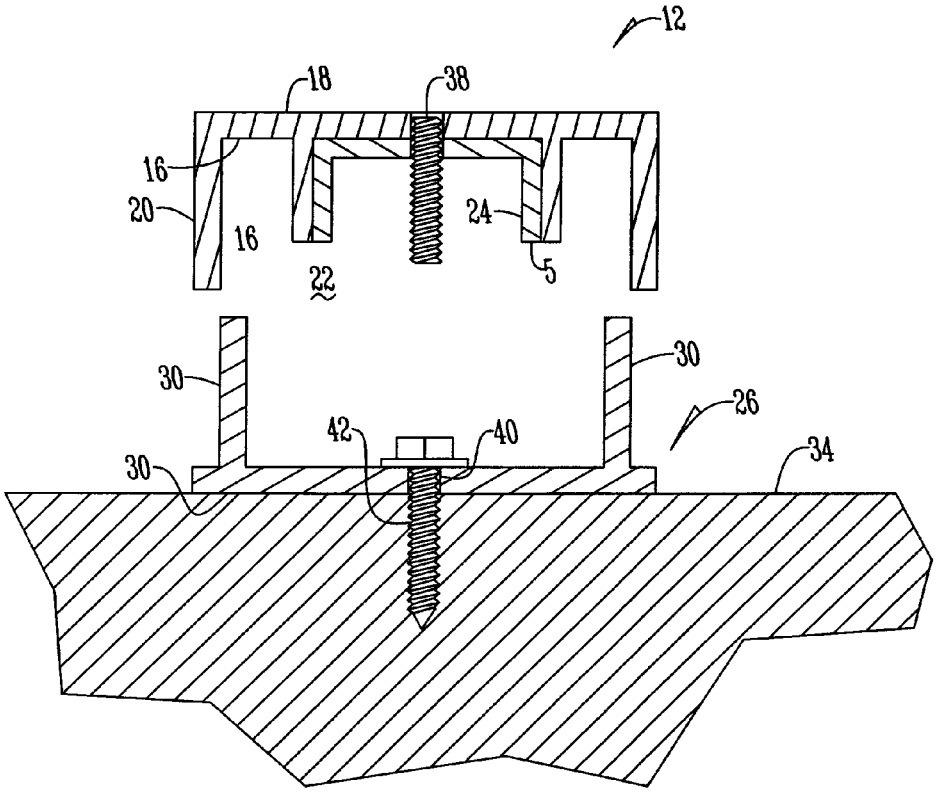
FIG. 3 is a sectional view of a frame system.

Referring to FIG. 2, the frame system 10 includes a window frame 12 having four elongated members 14 that are joined at their corners to form a square or rectangle and cavity frame 26. The frame system 10 is made of any material but preferably is made of PVC or the like. Each elongated member 14 has an inner surface 16 and an outer surface 18. At least one and preferably a plurality of holes 19 and 43 are positioned along the inner surface of frame 12. The outer surface 18 has two outwardly extending flanges 20 which form a web or channel 22 as shown in FIG. 3. In a preferred embodiment, disposed within the web 22 and extending along the outer surface 18 is a stiffener 24. The stiffener 24 is free standing, attached to the frame 12, or is molded as part of the frame 12.

Figure 1:
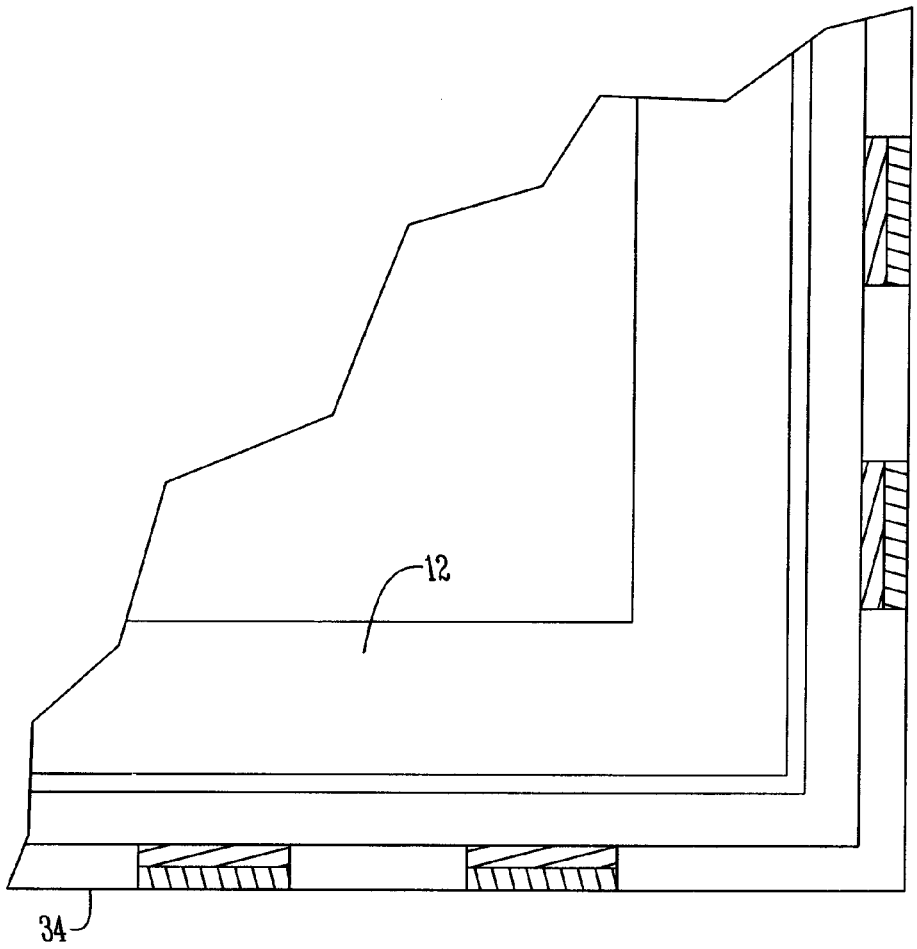
Fig. 1 Prior Art
FIG. 1 is a cut-out section of a prior art window frame.

A cavity frame 26 has four elongated members 27 with each having two side walls 30 as shown in FIG. 2. The side walls 30 are preferably positioned inwardly from the edge of the outer wall 28 and are generally perpendicular to the outer wall 28. The side walls 30 are positioned to fit frictionally and snugly within the flanges 20 of frame 12. The length of the elongated members 27 are longer than the elongated members 14 of the window frame 12 and have markings 32 at each end so that the cavity frame 26 can be cut to fit the wall opening 34 shown in FIG. 1. In the corners of the window frame 12 are a plurality of fill holes 36 used to hold the frame system 10 in place.

In operation, two of the elongated members 27 of the cavity frame 26 are inserted into the elongated members 14 of the window frame 12, one along the length and the other along the width of the frame system 10. A measurement is taken across the width of the frame system 10 and by adding ⅜th of an inch the width of the window opening 34 to be cut in the wall is determined. Similarly, a measurement is taken along the length and ⅜ of an inch is added to determine the length of the opening 34.

After cutting the opening, the ends of the cavity frame members 27 are trimmed to approximately ⅜ of an inch less the opening 34. The top and bottom cavity members 27 are placed against the opening 34 at one end and a line is drawn across the markings 32 at the opposite end of the members 27 at the edge of the opening 34. The distance between the end of the member 27 and the drawn line is the total amount to be removed and ½ of this distance plus 3/16 of an inch is cut from each end of the member 27. The same is done for the vertical measurement.

Once cut and assembled, the frame system 10 is placed in the opening 34. The frame is centered and leveled through the use of jack screws 38. The jack screws 38 are inserted through holes 19 and push the cavity frame 26 away from the window frame 12 to engage the edge of the opening 34. Using the cavity frame 26 as a template hole 40, locations are marked on the wall. Concrete screws 42 and washers are used to secure the frame system through access holes 43 to the wall. Each of the internal system corners are filled with foam through holes 36 to permanently lock the system together. Jack screws 38 are trimmed flush with inner surface 16.

Thus, an adaptable window frame system has been disclosed that at the very least meets all the stated objectives.

What is claimed is:

1. A window frame system comprising:

a window frame having a plurality of holes on an inner surface;

a cavity frame that is frictionally received within the window frame; and at least one screw inserted in the hole to adjust the position of the cavity frame in relation to the window frame to fit an opening in a wall;

wherein the window frame has two flanges with flat surfaces that extend outwardly to form a channel;

wherein the cavity frame has two sidewalls with flat surfaces that extend outwardly perpendicular to an outer wall;

a U-shaped stiffener positioned within the channel of the window frame;

wherein the flanges of the window frame are positioned in overlapping condition with the sidewalls of the cavity frame such that when the at least one screw is adjusted the screw pushes the cavity frame away from the window frame so that the cavity frame engages the edge of the wall opening.

2. The frame system of claim 1 wherein the ends of the cavity frame have markings.

3. A method of installing a window frame, comprising the steps of:

inserting a cavity frame within a window frame;

measuring the length and width of the inserted cavity frame;

cutting an opening in a wall based upon the measured length and width;

inserting the cavity frame and window frame in the opening;

centering and leveling the cavity frame and window frame using screws inserted through holes in the window frame;

wherein the window frame has two flanges with flat surfaces that extend outwardly to form a channel;

wherein the cavity frame has two sidewalls with flat surfaces that extend outwardly perpendicular to an outer wall;

wherein a U-shaped stiffener is positioned within the channel of the window frame;

wherein the flanges of the window frame are positioned in overlapping condition with the sidewalls of the cavity frame such that when the screws are adjusted the screw pushes the cavity frame away from the window frame so that the cavity frame engages the edge of the wall opening.

4. The method of claim 3 further comprising the step of filling holes in the corner of the cavity frame and window frame with foam.

5. The method of claim 3 further comprising the step of trimming the ends of the cavity frame based on the opening cut in the wall.

6. The method of claim 3 wherein the step of centering a leveling includes using the screws to push the cavity frame away from the window frame to engage an edge of the opening.

* * * * *